US009986793B2

(12) United States Patent
Atallah

(10) Patent No.: US 9,986,793 B2
(45) Date of Patent: Jun. 5, 2018

(54) FASTENER FOR FIREFIGHTER TURNOUT GEAR

(71) Applicant: Globe Holding Company LLC, Pittsfield, NH (US)

(72) Inventor: Toufic G. Atallah, Salem, NH (US)

(73) Assignee: Globe Holding Company LLC, Pittsfield, NH (US)

( * ) Notice: Subject to any disclaimer, the term of this patent is extended or adjusted under 35 U.S.C. 154(b) by 822 days.

(21) Appl. No.: 14/539,667

(22) Filed: Nov. 12, 2014

(65) Prior Publication Data

US 2015/0128333 A1 May 14, 2015

Related U.S. Application Data

(60) Provisional application No. 61/904,197, filed on Nov. 14, 2013.

(51) Int. Cl.
*A44B 19/38* (2006.01)
*A62B 17/00* (2006.01)

(52) U.S. Cl.
CPC ..... *A44B 19/38* (2013.01); *A62B 17/001* (2013.01); *A41D 2300/322* (2013.01); *A41D 2400/44* (2013.01); *A62B 17/003* (2013.01); *Y10T 24/2593* (2015.01)

(58) Field of Classification Search
CPC ..... A44B 19/38; A62B 17/001; A41D 2300/322; A41D 2400/44
See application file for complete search history.

(56) References Cited

U.S. PATENT DOCUMENTS 2,389,410 A * 11/1945 Butow ..... A41F 1/04 24/390
2,655,704 A * 10/1953 Simpson ..... A44B 19/38 24/433
3,962,729 A * 6/1976 Cook ..... A41H 37/003 2/234
9,706,816 B2 * 7/2017 Coakley ..... A44B 19/38

* cited by examiner

*Primary Examiner* — Richale Quinn
(74) *Attorney, Agent, or Firm* — Finch & Maloney PLLC

(57) ABSTRACT

A zipper type fastener for protective clothing, such as a firefighter or first responder turnout jacket is disclosed. One or more open ends of the zipper may be connected to the protective clothing by a zipper extender that creates a grip area to allow a user to more easily grasp the zipper end component(s) and fasten the zipper.

18 Claims, 6 Drawing Sheets

FASTENER FOR FIREFIGHTER TURNOUT GEAR

CROSS-REFERENCE TO RELATED PATENT APPLICATIONS

This application claims benefit of U.S. provisional application Ser. No. 61/904,197, filed on Nov. 14, 2013 and titled "FASTENER FOR FIREFIGHTER TURNOUT GEAR", the contents of which are hereby incorporated by reference in their entirety.

FIELD

This disclosure relates to protective clothing, such as firefighter and first responder turnout gear and, in particular, to a zipper fastener for protective clothing.

BACKGROUND

Firefighters and other emergency responders can be exposed to a variety of hazardous conditions, such as flame, smoke, and high heat. These individuals rely on protective clothing, including turnout gear, to protect their bodies from hazardous conditions they may encounter. Protective clothing is often secured with fasteners, such as zippers, snaps, and/or hooks. At times firefighters and other emergency responders must hurriedly change into protective clothing to quickly respond to emergencies. Traditional protective clothing fasteners can be difficult and time-consuming to secure properly. Thus, responders may be left vulnerable to hazards if their gear is not properly fastened, or valuable time may be wasted while properly securing cumbersome fasteners on their turnout gear.

SUMMARY

One example embodiment of the present disclosure includes a fastener for a protective garment. A first zipper element is connected to a first garment panel having a first closure edge. The first zipper element includes a first length of teeth and having a first open-ended engagement end that includes an insertion pin, the first length of teeth being separated from the first closure edge by a first separation distance. A second zipper element is connected to a second garment panel having a second closure edge. The second zipper includes a second length of teeth and having a second open-ended engagement end, the second length of teeth being separated from the second closure edge by a second separation distance. A slider is constructed and arranged to receive the insertion pin and to urge the first length of teeth and the second length of teeth into engagement with one another as the slider is moved along the second length of teeth away from the insertion pin. At least one of the first separation distance and the second separation distance is greater at the first open-ended engagement end and the second open-ended engagement end, respectively, than at points further away from the first open-ended engagement end and the second open-ended engagement end, respectively, to provide a grip area.

According to another example embodiment, a method of making a protective jacket is disclosed. The method includes constructing a jacket having a front portion including a first front panel and a second front panel. A first zipper element is connected to the first front panel and a grip area is created between a first open end of the first zipper element and the first front panel. A second zipper is element to the second front panel.

The present disclosure is not intended to be limited to a system or method that must satisfy one or more of any stated objects or features of the invention. It is also important to note that the present invention is not limited to the exemplary or primary embodiments described herein. Modifications and substitutions by one of ordinary skill in the art are considered to be within the scope of the present invention.

BRIEF DESCRIPTION OF THE DRAWINGS

In the drawings, different embodiments of the invention are illustrated in which.

DETAILED DESCRIPTION

Figure 1A:
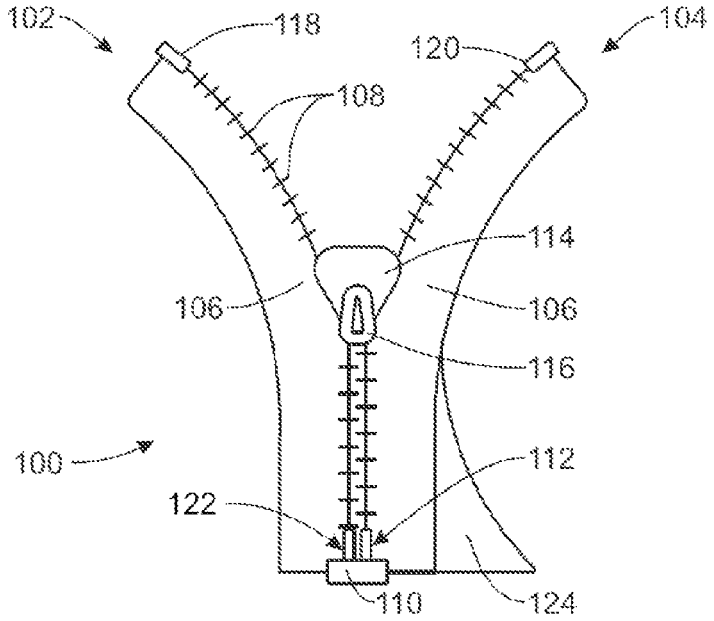
FIGS. 1A and 1B provide front views of a partially attached and completely detached embodiments of a zipper assembly.

Described herein is a zipper apparatus that, among other aspects, provides a grip area that enables easier and more time-efficient fastening of firefighter turnout gear and other types of protective clothing. The grip area may be formed by a zipper extender, which extends at least a portion of one zipper track away from a closure edge of the garment, thus creating an area that may be more readily gripped by a wearer of clothing. A zipper extender may typically be in the same plane as the zipper tape and as the front panels of the garment. Thus, the zipper extender may extend the end of a zipper track sideways, from left to right, or right to left. Incorporating a zipper extender into protective clothing may provide easier and faster access to the complementary zipper elements that are to be fastened together to secure the protective clothing. The zipper apparatus can be incorporated into a jacket, coat, vest, or other type of emergency response gear in which quick fastening or easier location of fastening components is desired.

Time is often of the essence when responding to a fire or other emergency. Firefighters and other emergency responders often change into emergency apparel very quickly when responding to an emergency. Typically, turnout gear and other protective clothing made for firefighters and other responders fastens in the front with a zipper. These zippers are usually open-ended, meaning that opposing sides of the zipper can both completely connect and completely detach. This configuration allows a user to easily put the jacket on by donning the jacket and fastening the zipper and to remove the jacket by unzipping the zipper. However, because both ends of the zipper completely detach, a user locates and aligns the slider of one zipper track and the insertion pin of the other zipper track each time the user wishes to fasten the jacket. While the disclosed zipper assembly is primarily described in this application as relating to turnout gear and other types of protective clothing, it should be understood that the subject matter of the present application is not so limited. For example, many of the embodiments described herein may be used in any garment employing a separating, or open-ended zipper. In some embodiments, a zipper assembly according to the present disclosure may be incorporated into outerwear that is not protective clothing. For example, a disclosed zipper assembly may be incorporated into exercise wear, wet suits, dry suits, winter jackets, overcoats, ski jackets, parkas, or ski pants.

Turnout gear often has multiple layers of fabric, such as liners, moisture and thermal barrier layers, and fire resistant layers. These protective layers can be heavy and bulky, making them cumbersome to manipulate. Furthermore, turnout gear usually incorporates flaps positioned along each side of the zipper fastener, to further insulate the closure region of the turnout gear. These flaps often are outfitted with components, such as reflective tape, hook and loop closures, and/or snaps, making the flaps rigid and difficult to maneuver. The flaps can also sometimes obscure the zipper components, making the zipper components difficult to locate. Thus, securing both ends of the zipper to one another during a fastening process may be challenging and time-consuming, especially when a responder is experiencing time pressure to respond to an emergency call and/or while donning bulky gloves. It is to be appreciated that exemplary embodiments of zipper extensions and grip areas are described herein with respect to turnout gear and turnout garments are described herein merely for the sake of convenience. The various embodiments described herein may also be incorporated into other types of protective clothing.

Protective clothing, as described herein, includes garments that provide protection to a wearer for hazards not normally associated with everyday garments. By way of example, protective clothing may be constructed to protect a wearer from flame, heat cold, wind, liquids, chemicals, particulates, pathogens, cuts, tears, abrasion, impact, puncture, compression, fire, ballistics, electrical arc, electrical conductivity, static electricity, radiation and the like. According to some embodiments, protective clothing is constructed in accordance with standards established by the National Fire Protection Association (NFPA), such as NPFA 1951 (incorporated by reference herein in its entirety) which identifies criteria for clothing suitable for wear in rescue and recovery activities. Similarly, NFPA 1971, also incorporated herein in its entirety, identifies criteria for clothing suitable for wear in structural firefighting activities. "Turnout gear" or "turnout clothing", as referenced herein, is understood to be suitable for wear in structural firefighting.

Figure 1B:
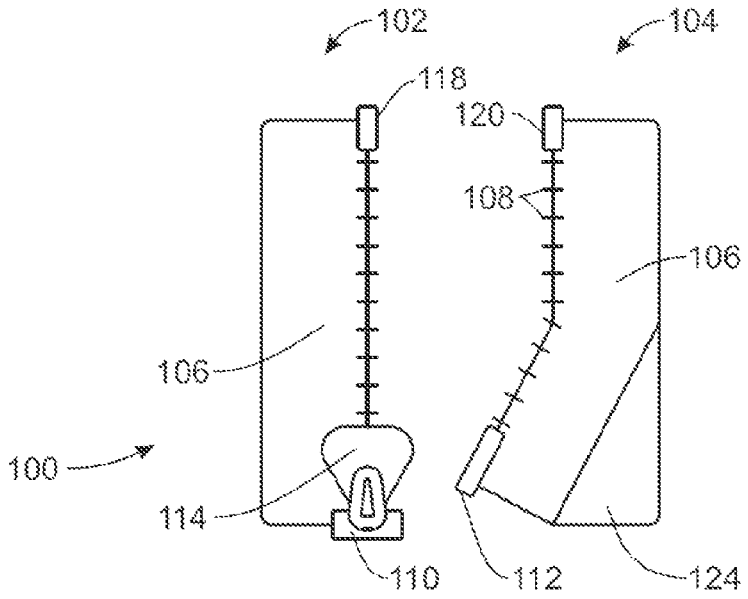

An open-ended zipper assembly is illustrated in FIGS. 1A and 1B. FIG. 1A shows a zipper assembly 100 that is partially connected and FIG. 1B shows a zipper assembly 100 that is entirely detached. The zipper assembly includes an extension 124 or grip area at the open end of the second zipper element, near the insertion pin 112. The zipper is includes a first zipper element 102 and a second zipper element 104. When the first zipper element 102 and the second zipper element 104 are interlocked, the zipper is closed. When first zipper element 102 and second zipper element 104 are not interlocked, the zipper is open. First zipper element 102 and second zipper element 104 may each include tape 106 with protruding teeth 108. Teeth 108 may be attached to tape 106 in a variety of ways. For example, teeth 108 may be attached to tape 106 in a coil configuration, wherein the coil winds around tape 106 to form teeth 108. Alternatively, teeth 108 may be formed individually from materials such as metal or plastic, and attached at regular intervals to tape 106. In another embodiment, teeth 108 may be secured directly onto the garment, without the use of tape 106. Teeth 108 may be formed from various materials, including plastic or metal. In one embodiment, a plastic molded zipper may be used to form zipper assembly 100. In another embodiment, a metal molded zipper may be used to form zipper assembly 100. In yet another embodiment, an airtight zipper may be used to form zipper assembly 100. In a further embodiment, a water-resistant zipper may be used to form zipper assembly 100.

The zipper assembly may also contain a retainer box 110 and an insertion pin 112, as shown in FIGS. 1A-1B. Retainer box 110 may be attached to the bottom of first zipper element 102, and may be used to keep slider 114 slidably connected to tape 106. Insertion pin 112 may be attached to the bottom of second zipper element 104 and may be placed into slider 114 and retainer box 110 to initiate closing of the zipper. When insertion pin 112 is placed into slider 114, slider 114 may be pulled in the opposing direction from insertion pin 112, and engage teeth 108 to interlock complementary teeth on opposed zipper elements, as shown in FIG. 1A. When pulled in the reverse direction, slider 114 may disengage teeth 108, and may completely disconnect first zipper element 102 from second zipper element 104, as shown in FIG. 1B. Slider 114 may optionally have a pull tab 116 to allow for enhanced manipulation.

First zipper element 102 and/or second zipper element 104 may optionally be equipped with top stops 118 and 120. Top stops 118 and/or 120 may be useful to secure slider 114 onto teeth 108. However, top stops 118 and/or 120 need not be used if, for example, an upper portion of either zipper element is secured into a connecting piece of fabric, or slider 114 is otherwise retained on teeth 108. First zipper element 102 may also optionally have a bottom stop 122, to facilitate slider 114 movement on teeth 108, as shown in FIG. 1A.

Figure 2:
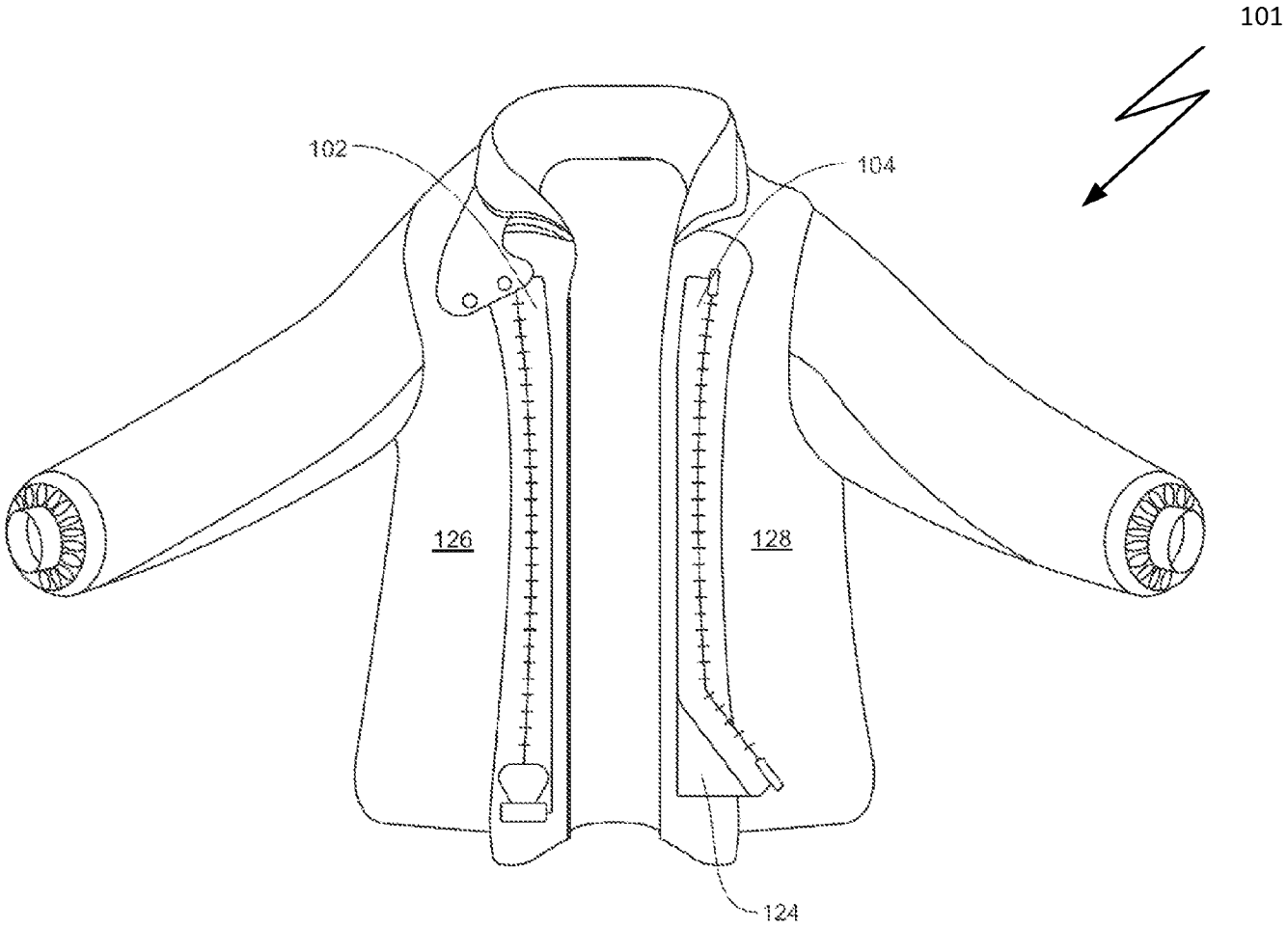
FIG. 2 provides a front view of an opened jacket, incorporating an embodiment of a zipper extender.

In an embodiment as shown in FIG. 2, a zipper extender 124 may be attached to an open ended portion, shown on the lower portion, of second zipper element 104. In another embodiment, zipper extender 124 may be attached to a lower portion of first zipper element 102. In one embodiment, a first zipper extender is attached to an open ended, lower portion of first element 102 and a second zipper extender is attached to an open ended, lower portion of second zipper element 104. FIG. 2 shows an embodiment of a zipper assembly attached to a jacket 101, the zipper assembly includes a zipper extender 124, that is attached to both the garment's left front panel 128 and the second zipper element 104. The zipper extender 124 creates an enlarged grip area between a zipper element and a portion of a garment to which the zipper tape would otherwise be directly fastened. The grip area provides a wearer a larger area to grab and hold when the wearer is locating the open end of the zipper element that includes the insertion pin 112 (and/or retainer box 110) for assembly to the retainer box 110 of the opposed zipper element. It should be noted that zipper extender 124 may be incorporated onto either the garment's left front panel 128 or the garment's right front panel 126 and may accordingly be connected to either first zipper element 102 or second zipper element 104. Furthermore, two zipper extenders and corresponding enlarged grip areas may be incorporated into a single garment, whereby one zipper extender 124 is located on the garment's front left panel 128 and one zipper extender 124 is located on the garment's front right panel 126.

In some embodiments, the jacket 101 may be a turnout jacket. In other embodiments, jacket 101 may be a turnout coat or vest. In further embodiments, jacket 101 may be a parka, wet suit, coat, or winter sports coat. In other embodiments, jacket 101 may be a motorcycle jacket, bomber jacket, field jacket, or other type of coat or jacket.

Figure 3:
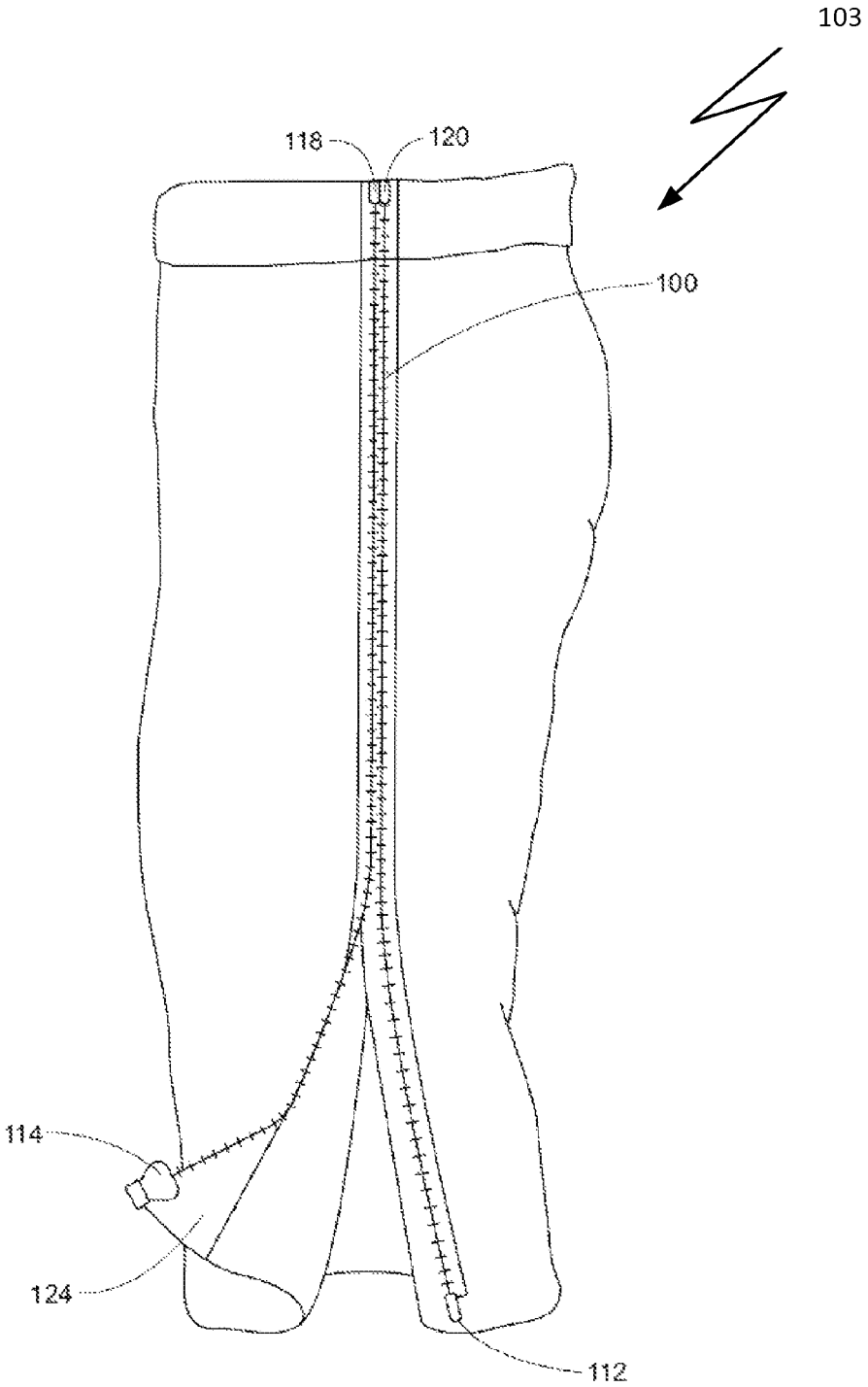
FIG. 3 provides a perspective side view of pants incorporating an embodiment of a zipper extender.

In one set of embodiments, at least one zipper extender 124 may be used in types of garments not illustrated in FIG. 2, such as pants 103, illustrated in FIG. 3. For example, pants 103 may be outfitted with two zipper assemblies 100, one on each leg of the pant. The zipper assemblies 100 may allow a user fasten and unfasten pants 103 without needing to pull the pants 103 over the legs. Such an embodiment may be useful when wearing ski boots, or if a user's leg is outfitted in a cast or otherwise immobilized. Each zipper assembly may extend the full length of the garment. When zipper assemblies on right and left pant legs are both unattached the garment can be divided into a front panel and a back panel that are separate from each other. As shown in FIG. 3, zipper extender(s) 124 may be incorporated near the bottom hem of the pant leg, and may be useful in aiding a user don the pants and providing space to accommodate bulky footwear. In one embodiment, a pair of ski pants is formed to have one zipper assembly 100 comprising an extender 124 on the bottom right leg of the pant, and have one zipper assembly 100 comprising a zipper extender 124 on the bottom left leg of the pant. Zipper assemblies 100 may each extend from the pant waist to the bottom hem. In this embodiment, the zipper extenders 124 may aid a user in fastening ski pants over ski boots without requiring the user take the ski boots off to remove or don pants 103. Also, the zipper extenders 124 may provide space at the bottom of the pant legs to accommodate footwear, such as ski boots.

In further embodiments, zipper assemblies 100 as disclosed may be incorporated into turnout gear to fasten and remove components from the turnout garment. For example, in some embodiments, a zipper assembly 100 comprising a zipper extender 124 may be incorporated into a turnout coat or jacket and attach or detach a removable feature, such as a pocket, collar, or hood to the turnout coat. In other embodiments, a zipper assembly 100 comprising a zipper extender 124 may be incorporated into turnout pants and selectively attach or detach a removable feature to the turnout pants. Such removable features may include, for example, a pocket, a tool belt, or a patch.

The material used to form zipper extender 124 may be substantially flexible or substantially rigid. In one embodiment, zipper extender 124 is molded or extruded. In another embodiment, zipper extender 124 is formed from woven fabric. In a further embodiment, zipper extender 124 is formed from nonwoven fabric. Zipper extender 124 may also be formed to have enhanced resistance to hazardous conditions. For example, a zipper extender 124 for a fire-fighting turnout suit could be made from fire-resistant materials, water-resistant materials, and/or chemically-resistant materials. In one embodiment, zipper extender 124 may incorporate aramid fibers such as DuPont™ NOMEX® and/or KEVLAR® brand fibers. In another embodiment, cotton-nylon blend fibers may also be used, at least in part, to form zipper extender 124. In yet another embodiment, wool, cotton, and/or polyester fabrics may be used, at least in part, to construct zipper extender 124. Optionally, the material chosen to construct zipper extender 124 may be chemically treated to achieve flame-resistance, or flame-retardant characteristics, and may be hemmed to create a reinforced seam.

Figure 4A:
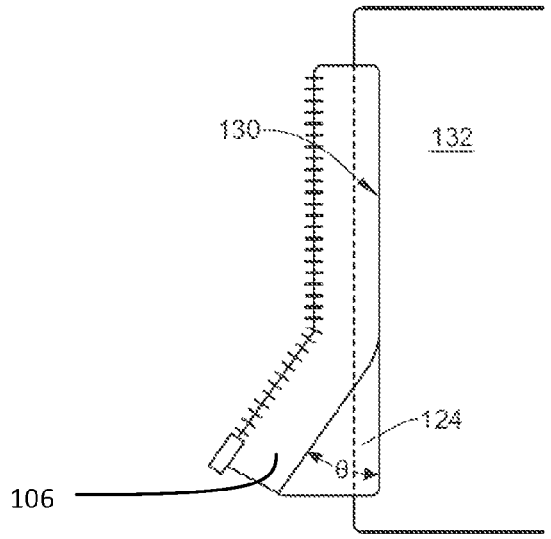
FIGS. 4A, 4B, 4C, 4D, and 4E show various embodiments of a zipper extender.
Figure 4B:
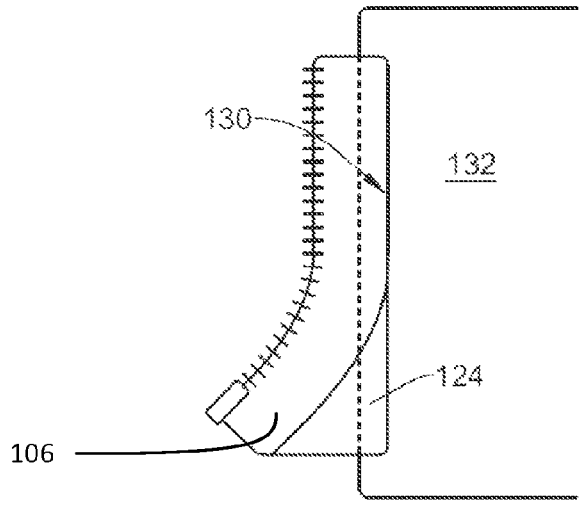
Figure 4C:
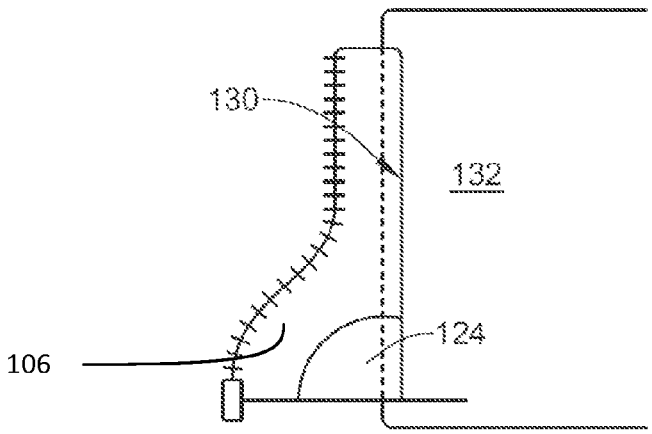
Figure 4D:
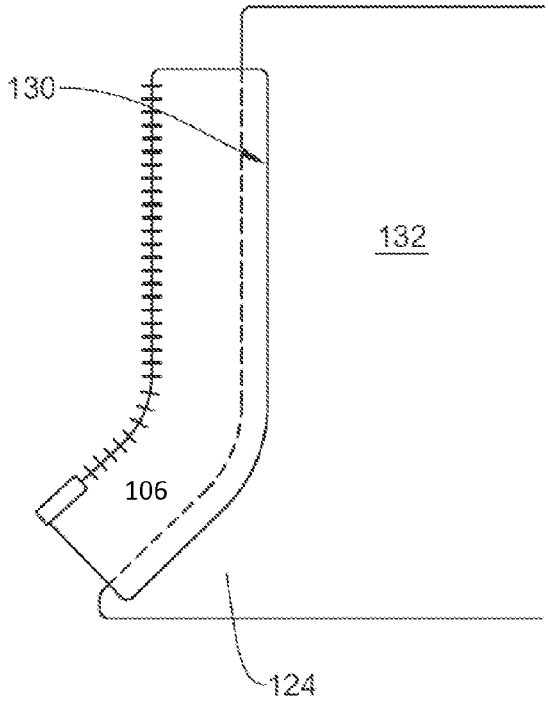

Zipper extender 124 may be formed in a variety of shapes. FIGS. 4A-4E illustrate just a few exemplary embodiments of a zipper extender 124. For example, FIG. 4A shows a zipper extender 124 that is substantially triangular. In such an embodiment, the seam securing zipper extender 124 to panel 132 may be substantially linear with respect to the upper portion of the zipper. A triangular embodiment of zipper extender 124, as shown in FIG. 4A, may form an angle θ, between the tape edge 130 and the intersection of zipper extender 124 with panel 132. Angle θ may be, for example, within the range of 5°-45°. In one embodiment, angle θ is approximately 30°. In other embodiments, zipper extender 124 is curved in a convex and/or a concave manner. For example, in FIG. 4B, zipper extender 124 is concavely curved. In FIG. 4C, yet another embodiment is shown, wherein zipper extender 124 is convexly curved. In further embodiments, zipper extender 124 may be in the shape of a quarter circle, a subparabolic half, an elliptical quarter, a parallelogram, or may take the shape of a combination of any of these shapes.

Zipper extender 124 may be formed using a variety of methods. For example, zipper extender may be formed from a piece of the turnout gear front panel itself, from zipper tape 106, and/or may be formed from an independent piece of material. For instance, as illustrated in FIGS. 4A-4C, zipper extender 124 may be formed from a material that is separate from panel 132 and/or separate from tape 106.

In other embodiments, zipper extender 124 may be integral to the panel of a garment or to tape 106. "Integral" means that the zipper extender is formed from the same piece of material. In an embodiment shown in FIG. 4D, zipper extender 124 is integral to the left front panel of turnout gear. In such an embodiment, the left front panel of a turnout jacket may be cut to include additional fabric that will comprise zipper extender 124. In another embodiment, zipper extender 124 may be integral to the right front panel of the turnout gear. The right front panel may be a panel of an inner layer, a middle layer or an outer layer. An outer layer may be made of material such as an abrasion resistant material, e.g., para-aramid fibers, Kevlar®, Nomex®, PBI®, PBO, or any combination of these materials. The outer layer may include blend spun yarn, which may include one or more of these materials. In such an embodiment, the right front panel of the turnout gear may be cut to include additional material that will comprise zipper extender 124. In another embodiment, both the right front panel and the left front panel may be cut to include additional material that will comprise both a left side zipper extender and a right side zipper extender. The additional material included in the front panel can take a variety of shapes. For example, the material can take the form of a triangle, a quarter circle, a subparabolic half, an elliptical quarter, a parallelogram, or any other suitable shape.

Figure 4E:
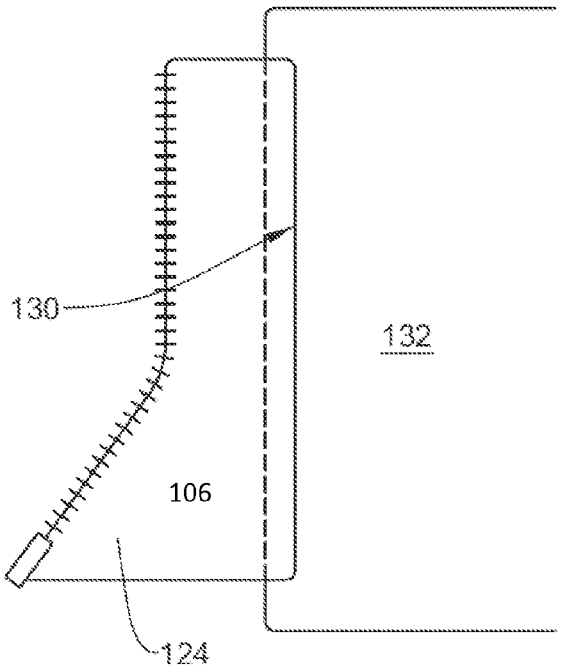

In other embodiments, zipper extender 124 is integral to tape 106, as illustrated in FIG. 4E. In such an embodiment, zipper extender 124 may be created by forming a zipper tape 106 that is at least two times wider at a first end compared to a second end. For example, a tape may be cut on a taper so that tape 106 is at least two times wider at a first end as compared to a second end. Teeth 108 may then be attached to tape 106. In another example, teeth 108 may first be attached to a tape 106 and then tape 106 may be cut to be wider at a first end compared to a second end. In some embodiments, tape 106 may have a width at a top end within the range of 0.2-2 inches. In some embodiments, tape 106 may have a width at a bottom end within the range of 0.4-6 inches.

Figure 5A:
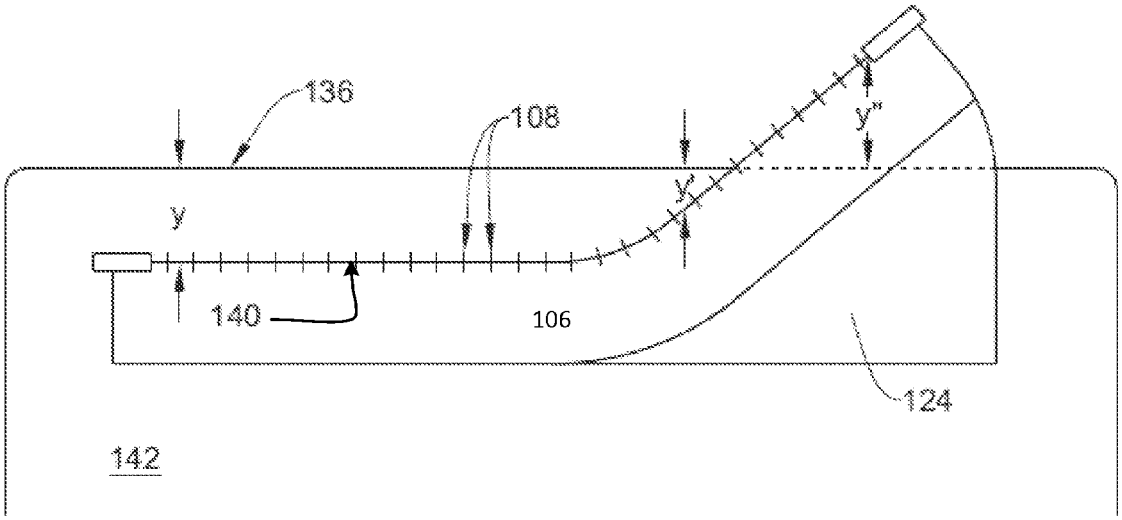
FIGS. 5A and 5B provide a side view of an embodiment of a zipper assembly attached to a turnout jacket.
Figure 5B:
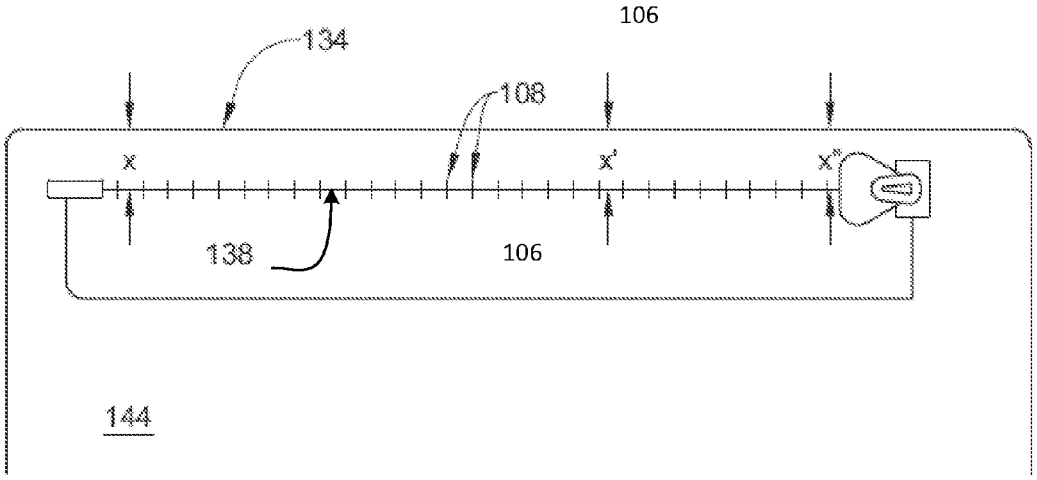

FIGS. 5A and 5B show a side view of an embodiment of a zipper assembly attached to a turnout jacket. Specifically, the sides of the jacket depicted in FIGS. 5A and 5B are oriented such that FIG. 5A shows the inside surface 142 of the jacket and FIG. 5B shows the outside surface 144 of the jacket. In this embodiment, the first zipper track 138 and the second zipper track 140 are configured to interlock, or mate.

When interlocked, the zipper assembly is designed to join the first jacket panel closure edge 134 with the second jacket panel closure edge 136. In some embodiments, first jacket panel closure edge 134 and second jacket panel closure edge 136 overlap when first zipper track 138 and second zipper track 140 are interlocked. In other embodiments, first jacket panel closure edge 134 and second jacket panel closure edge 136 do not overlap when first zipper track 138 and second zipper track 140 are interlocked. In further embodiments, first jacket panel closure edge 134 and second jacket panel closure edge 136 overlap only in part when first zipper track 138 and second zipper track 140 are interlocked.

In some embodiments, the area surrounding the interlocked zipper tracks may contain additional insulation or protective layers. For example, flaps may be included on inside surface 142 and/or outside surface 144 to provide additional insulation, water resistance or protection to the zipper. In some embodiments, first zipper track 138 may be positioned inside first jacket panel closure edge 134, thus allowing the material located between first zipper track 138 and first jacket panel closure edge 134 to provide additional insulation to the zipper. Similarly, in some embodiments, second zipper track 140 may be attached inside second jacket panel closure edge 136, thus allowing the material located between second zipper track 140 and second jacket panel closure edge 136 to provide additional insulation to the zipper.

As shown in FIG. 5B, first zipper track 138 may be attached to outside surface 144 along first jacket panel closure edge 134. In the embodiment shown, first zipper track 138 is attached to outside surface 144 at points along tape 106. For example, tape 106 may be sewn onto outside surface 144. In another embodiment, teeth 108 may be fastened directly onto outside surface 144, and not onto tape 106. The distance between the teeth of first zipper track 138 and first jacket panel closure edge 134 at any point may be measured by distances x, x' and x". Distance x corresponds to the distance between teeth 108 and first jacket panel closure edge 134 at a top end of first zipper track 138. Distance x' refers to a distance between teeth 108 and first jacket panel closure edge 134, as taken along the shortest path that lies along material of the jacket, at some point more than half way down the length of first zipper track as measured from the top end of the zipper track. Distance x" denotes the distance between teeth 108 and first jacket panel closure edge 134 at a bottom end of the first zipper track 138 (again, as taken along the shortest path that lies along the material). As shown in FIG. 5B, x, x', and x" are all equal or approximately equal. In some embodiments, distances x, x', and/or x" may be referred to as "first distance."

In an embodiment such as that shown in FIG. 5A, second zipper track 140 may be attached to inside surface 142 and proceed along second jacket panel closure edge 136. The distances between the teeth of second zipper track 140 and second jacket panel closure edge 136 may be measured at any point by distances y, y', and y". Distance y corresponds to the distance between teeth 108 and second jacket panel closure edge 136 at a top end of second zipper track 140. Distance y' refers to a distance between teeth 108 and second jacket panel closure edge 136 at some point more than halfway down the length of the second zipper track, as measured from the top end of the zipper track, and distance y" denotes the distance between teeth 108 and second jacket panel closure edge 136 at a bottom end of second zipper track 140.

Relative distances for x, x', x" are calculated by using distance x as a baseline. Relative distances for y, y', and y" can be calculated by using distance y as a baseline. Distance x is the distance between teeth 108 and first closure edge 134. Distance y is the distance between teeth 108 and second closure edge 136. For purposes of calculating relative distances, x and y will always be normalized to zero. For example, if at the point where distance y is measured, zipper teeth are 1 inch inside the second jacket panel closure edge 136, at the point where y' is measured, zipper teeth are 0.5 inches inside second jacket panel closure edge 136, and at the point where y" is measured, zipper teeth are 1 inch beyond second jacket panel closure edge 136, the relative distances are as follows: 1 inch inside the second jacket panel closure edge 136 is the baseline for the measurements, so therefore, y is 0, y' is 0.5 inches, and y" is 2 inches.

In one embodiment, x, x' and x" are all equal. In another embodiment, x and x' are equal, and x" is greater than both of these distances. In yet another embodiment, the relative distances of x is less than x', and the relative distance for x' is less than x". In an additional embodiment, the relative distance of x is less than x', and x' is equal to x". In some cases, x" may more than 2×, 3× or 4× x or x'. In other cases, x" may be greater than or equal to x+0.5 inch, x+1.0 inch, x+2.0, x'+0.5 inch, x'+1.0 inch or x'+2.0 inch.

In another embodiment, y, y', and y" are all equal. In yet another embodiment, relative distances for y and y' are equal, and y" is greater than both of these distances. In still another embodiment, the relative distance of y is less than y' and the relative distance for y' is less than y". In a further embodiment, the relative distance of y is less than y', and y' is equal to y". In some cases, y" may more than 2×, 3× or 4× y or y'. In other cases, y" may be greater than or equal to y+0.5 inch, y+1.0 inch, y+2.0, y'+0.5 inch, y'+1.0 inch or y'+2.0 inch.

In one embodiment, the relative distance of x" from x and/or y" from y may be within the range of 0-5 inches. For example, a coat for a first responder may have a right front panel with a first zipper track attached near a first closure edge, with relative distances of x=0, x'=0, and x"=0. In this or another example, a coat for a first responder may have a left front panel with a second zipper track attached near a second closure edge, with relative distances of y=0, y'=0.2 inches, and y"=2 inches. In some embodiments, y' is located ⅔ down the length of the second zipper track 140. In other embodiments, y' is located ¾ down the length of the second zipper track 140. In further embodiments, y' is located ⅞ down the length of the second zipper track 140. In other embodiments, y' is located within the range of 0.2-10 inches from the bottom of second zipper track 140.

In yet another embodiment, first zipper track 138 is attached to outside surface 144 at about 1 inch inside first jacket panel closure edge 134. The relative distances of x' and x" are each 0, meaning that zipper track 138 is consistently 1 inch inside first jacket panel closure edge 134, as measured from teeth 108 of first zipper track 138. An upper portion of second zipper track 140 may be attached to inside surface 142 at about 1 inch inside second jacket panel closure edge 136; y' may be longitudinally located within the range of 1-6 inches from the bottom end of second zipper track 140, and the relative distance of y' may be 0 inches. In this or another embodiment, y" is within the range of 0.5-4 inches.

In one embodiment, first zipper track 138 may be attached to outside surface 144 such that first zipper track 138 does not extend outside first jacket panel closure edge 134. In another embodiment, first zipper track 138 may be attached to outside surface 144 such that the entirety of first zipper track 138 extends beyond first jacket panel closure edge 134.

In yet another embodiment, first zipper track 138 may be attached to outside surface 144 such that only a portion of first zipper track 138 extends beyond first jacket panel closure edge 134. Similarly, second zipper track 140 may be attached to inside surface 142 such that second zipper track 140 does not extend above second jacket panel closure edge 136. In a different embodiment, second zipper track 140 may be attached to inside surface 142 such that the entirety of second zipper track extends beyond second jacket panel closure edge 136. In another embodiment, second zipper track 140 may be attached to inside surface 142 such that only a portion of second zipper track 140 extends beyond second jacket panel closure edge 136.

In one embodiment, first zipper track 138 may be attached to a right front panel of a firefighter's jacket and proceed along a first jacket panel closure edge 134 at a constant distance of about 1 inch inside the panel's edge. Second zipper track 140 may be attached to the left front panel of the firefighter's jacket and proceed linearly at a constant distance from the second jacket panel closure edge 136, until approximately 6 inches from the bottom end of second zipper track 140 where its angle changes with respect to the second jacket panel closure edge 136. In some embodiments, the bottom end of second zipper track 140 may extend about 1 inch beyond the second jacket panel closure edge 136. In some embodiments, the second zipper track 140 does not extend beyond second jacket panel closure edge 136, but the bottom portion of zipper track 140 is closer to second jacket panel closure edge 136 than a top portion of zipper track 140.

Zipper extender 124 may be attached to a garment in a variety of ways. For example, zipper extender 124 may first be attached to a zipper element and the zipper extender 124 may then be attached onto a front panel of a garment. Alternatively, zipper extender may first be attached to a front panel of a garment and the zipper element may then be attached to both the front panel of the garment and to the zipper extender. In one embodiment, the zipper element(s) may be sewn to the front panel and to the zipper extender. For example, the tape of the zipper element may be sewn onto a front panel of the garment using thread. Various stitches are suitable for fastening the zipper to the panel, including a running stitch, a top stitch, or a zigzag stitch. Multiple rows of stitches may also be used to fasten the zipper. In another embodiment, zipper elements may be glued, taped, stapled, welded, or laminated into place.

Various protective layers may also be incorporated into the turnout gear. For example, protective flaps may extend on one or both sides of the zipper elements to afford extra protection to the zipper. These flaps may be secured with any fastening means, including snaps, hook and loop, or buttons. Similarly, a collar may be included on the turnout gear to further insulate the garment near a top region of the zipper.

In one embodiment, a firefighter receives an emergency call that requires him or her to don turnout gear. The firefighter dons turnout pants and boots. The firefighter dons a turnout coat that incorporates a zipper apparatus including a zipper extender. The firefighter reaches one hand toward the zipper component fastened to the left panel of the turnout gear and the other hand toward the zipper component fastened to the right panel of the turnout gear. The zipper component fastened to the left panel of the turnout gear may be an insertion pin, and the zipper component fastened to the right panel may be a slider. In another embodiment, the zipper component fastened to the left panel may be a slider. The firefighter is able to easily access the zipper components as the slider is relatively large and the zipper extender positions the insertion pin at an accessible distance, farther away from the front panel of the coat than an upper portion of the zipper track. Thus, the firefighter need not contend with various protective layers and/or flaps of the garment to locate the zipper components. The firefighter places one hand on the bottom of a zipper track that includes the slider and the other hand on the bottom of a zipper track that includes the zipper extender and the insertion pin. The firefighter inserts the insertion pin into the slider and zips the coat. In some embodiments, zipper extender and insertion pin are located on a firefighter's left side while donning the turnout coat. In other embodiments, the zipper extender and insertion pin are located on a firefighter's right side while donning the turnout coat.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A fastener for a protective garment, comprising:

a first zipper element connected to a first garment panel having a first closure edge, the first zipper element including a first length of teeth and having a first open-ended engagement end that includes an insertion pin, the first length of teeth separated from the first closure edge by a first separation distance;

a second zipper element connected to a second garment panel having a second closure edge, the second zipper element including a second length of teeth and having a second open-ended engagement end, the second length of teeth separated from the second closure edge by a second separation distance;

a slider constructed and arranged to receive the insertion pin and to urge the first length of teeth and the second length of teeth into engagement with one another as the slider is moved along the second length of teeth away from the insertion pin; and wherein at least one of the first separation distance and the second separation distance is greater at the first open-ended engagement end and the second open-ended engagement end, respectively, than at points further away from the first open-ended engagement end and the second open-ended engagement end, respectively, to provide a grip area.

2. The fastener of claim 1, wherein the first separation distance is greater at the first open-ended engagement end than at points along the first zipper element that are further away from the first open-ended engagement end to form the grip area adjacent the insertion pin.

3. The fastener of claim 2, wherein the slider is positioned to be actuated by a left hand of a wearer of the protective garment with the grip area constructed and arranged to be gripped by a right hand of the wearer of the protective garment.

4. The fastener of claim 3, wherein the second separation distance is greater at the second open-ended engagement end than at points along the second zipper element that are further away from the second open-ended engagement end to provide grip area constructed and arranged to be griped by a left hand of the wearer of the protective garment.

5. The fastener of claim 2, wherein the slider is positioned to be actuated by a right hand of a wearer of the protective garment with the grip area constructed and arranged to be gripped at least by a left hand of the wearer of the protective garment.

6. The fastener of claim 1, wherein the second separation distance is greater at the second open-ended engagement end than at points along the second zipper element that are further away from the second open-ended engagement end.

7. The fastener of claim 6, wherein the slider is positioned to be actuated by a left hand of a wearer of the protective garment with the grip area constructed and arranged to be gripped by a right hand of the wearer of the protective garment.

8. The fastener of claim 6, wherein the slider is positioned to be actuated by a right hand of a wearer of the protective garment with the grip area constructed and arranged to be gripped at least by a left hand of the wearer of the protective garment.

9. The fastener of claim 1, wherein each of the first separation distance and the second separation distance is substantially constant at points that lie away from the grip area.

10. The fastener of claim 1, wherein the grip area is formed between at least one of the first zipper element and the second zipper element that is angled with respect to a corresponding one of the first closure edge and the second closure edge by an angle within the range of 5°-45°.

11. The fastener of claim 10 wherein the angle is positioned within a range of 3-6 inches from a corresponding one of the first open-ended engagement end and the second open-ended engagement end.

12. The fastener of claim 1, wherein at least one of the first separation distance and the second separation distance is at least two or more times greater at a corresponding one of the first open-ended engagement end and the second open-ended engagement end than at points further away from the corresponding one of the first open-ended engagement end and the second open-ended engagement end.

13. The fastener of claim 1, wherein the grip area is formed at least in part by material secured to a zipper tape of one of the first zipper element and the second zipper element and a corresponding one of the first closure edge and the second closure edge.

14. The fastener of claim 1, wherein the grip area is formed by material of a zipper tape of one of the first zipper element and the second zipper element.

15. The fastener of claim 1, wherein the grip area is formed by material that is integral with a corresponding one of the first closure edge and the second closure edge.

16. The fastener of claim 1, in combination with the protective garment, wherein the protective garment includes a jacket, the first open-ended engagement end and the second open-ended engagement end located near a waist of a wearer when the jacket is worn.

17. The combination of claim 16, wherein the jacket is a turnout jacket that is constructed and arranged for structural firefighting.

18. The combination of claim 16, wherein the jacket includes a closure flap attached to one of the first garment panel and the second garment panel and that is connectable to another of the second garment panel and the first garment panel, the closure flap obscuring at least a majority of the fastener when the closure flap is connected.

* * * * *